US008048603B2

(12) United States Patent
Tsubaki et al.

(10) Patent No.: US 8,048,603 B2
(45) Date of Patent: Nov. 1, 2011

(54) TONER, TWO-COMPONENT DEVELOPER, DEVELOPING DEVICE, AND IMAGE FORMING APPARATUS

(75) Inventors: Yoritaka Tsubaki, Nara (JP); Yasuo Imura, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 485 days.

(21) Appl. No.: 12/267,811

(22) Filed: Nov. 10, 2008

(65) Prior Publication Data

US 2009/0123858 A1 May 14, 2009

(30) Foreign Application Priority Data

Nov. 13, 2007 (JP) ..... P2007-294853

(51) Int. Cl.
*G03G 9/08* (2006.01)

(52) U.S. Cl. ..... 430/110.1; 430/110.3; 430/110.4

(58) Field of Classification Search ..... 430/110.1, 430/110.3, 110.4
See application file for complete search history.

(56) References Cited

U.S. PATENT DOCUMENTS

| | | | | |
|---|---|---|---|---|
| 5,738,962 | A | 4/1998 | Ichimura et al. | |
| 5,912,101 | A * | 6/1999 | Karaki et al. | 430/110.3 |
| 6,200,719 | B1 * | 3/2001 | Kuroda | 430/137.1 |
| 6,911,289 | B2 | 6/2005 | Higuchi et al. | |
| 2004/0253531 | A1 * | 12/2004 | Ota et al. | 430/137.2 |
| 2005/0266333 | A1 * | 12/2005 | Yoshimoto et al. | 430/137.2 |
| 2007/0059626 | A1 | 3/2007 | Inoue et al. | |
| 2007/0148580 | A1 * | 6/2007 | Suzuki et al. | 430/110.3 |
| 2007/0218382 | A1 | 9/2007 | Emoto et al. | |

FOREIGN PATENT DOCUMENTS

| | | |
|---|---|---|
| JP | 07-199520 | 8/1995 |
| JP | 09-114127 | 5/1997 |
| JP | 2002-304006 | 10/2002 |
| JP | 2003-262981 A | 9/2003 |
| JP | 2005-31159 A | 2/2005 |
| JP | 2005-091958 | 4/2005 |
| JP | 2005-234410 | 9/2005 |
| JP | 2006-301093 A | 11/2006 |
| JP | 2007-79196 A | 3/2007 |
| JP | 2007-279714 A | 10/2007 |

* cited by examiner

*Primary Examiner* — Hoa Le
(74) *Attorney, Agent, or Firm* — Nixon & Vanderhye, P.C.

(57) ABSTRACT

A toner is composed of toner particles which contain at least a binder resin, a colorant, and a release agent. As to particle size distribution and particle number distribution of the toner particles, a volume average particle size of the toner particles is set to be 3.0 μm to 6.0 μm, and a content of 5.0 μm or smaller toner particles is set to be 40% by number while a content of 8.0 μm or larger toner particles is set to be less than 2% by volume. Furthermore, an amount of the release agent in toner particle surface is set to be 0.7% by weight or more and 1.8% by weight or less. And furthermore, the release agent is a petroleum-based release agent.

10 Claims, 3 Drawing Sheets

TONER, TWO-COMPONENT DEVELOPER, DEVELOPING DEVICE, AND IMAGE FORMING APPARATUS

CROSS-REFERENCE TO RELATED APPLICATION

This application claims priority to Japanese Patent Application No. 2007-294853, which was filed on Nov. 13, 2007, the contents of which are incorporated herein by reference in its entirety.

BACKGROUND OF THE INVENTION

1. Field of the Invention

The present invention relates to a toner, a two-component developer, a developing device, and an image forming apparatus.

2. Description of the Related Art

A toner is used to visualize a latent image in various image forming processes, and one known example thereof is an electrophotographic image forming process.

An electrophotographic image forming apparatus has been widely used as copiers so far, and in recent days, also as printers, facsimile machines, and the like equipment along with spread of computers since the electrophotographic image forming apparatus operates excellently as output units for computer images created by computers. In a general electrophotographic image forming apparatus, a desired image is formed on a recording medium through a charging step, an exposing step, a developing step, a transferring step, a fixing step, and a cleaning step. In the charging step, a photosensitive layer on a surface of a photoreceptor drum is homogeneously charged. In the exposing step, the charged surface of the photoreceptor is irradiated with signal light corresponding to an original image so that an electrostatic latent image is formed. In the developing step, an electrophotographic toner (hereinafter referred to simply as "toner") is supplied to the electrostatic latent image on the surface of the photoreceptor drum so that the electrostatic latent image is formed into a visualized image. In the transferring step, the visualized image on the surface of the photoreceptor is transferred onto a recording medium such as paper or OHP sheet. In the fixing step, the visualized image is fixed onto the recording medium by heat, pressure, etc. In the cleaning step, a toner and other matters remaining on the surface of the photoreceptor from which the visualized image has been transferred, are removed by a cleaning blade, and the surface of the photoreceptor is thus cleaned. Note that the visualized image may be transferred onto the recording medium by way of an intermediate transfer medium.

In recent years, there has been a tendency to make a toner particle smaller in order to meet the demand of higher image quality. However, there arises a problem of fog caused on a non-image part and in particular, the fog generated after toner replenishment is problematic. This problem of fog caused on a non-image part arises due to a fact that the smaller diameter of toner particles increases a charge amount in bulk while a charge amount on each toner particle (especially a charge amount on a small toner particle) is so small that the charge on the toner particle is not sufficiently controlled, which makes charge amount distribution unstable. In order to improve such instability of the charge amount distribution, the following methods have been proposed.

Japanese Unexamined Patent Publication JP-A 7-199520 (1995) discloses a technique of mixing at least two groups of toner particles that are different in average particle size and each contain at least one internal additive (magnetic powder, charge control agent, and lubricant) of which particles are different in size from group to group, to thereby minimize a difference in charge amount among particles depending on their sizes, which difference is attributable to an increase in breadth of toner particle size distribution, thus allowing for stable image quality having no fog on the non-image part.

Japanese Unexamined Parent Publication JP-A 9-114127 (1997) discloses a technique of balancing high image quality with developability (proper density with fog prevention) by setting specific conditions on a volume average particle size, a content of color material, and a weight of a toner to be developed, with the respect to the toner having a volume average particle size of 3.0 μm to 9.0 μm, and in order to form a higher-quality image, it discloses setting of the particle size distribution to $D_{50P}/D_{84P} \leqq 1.45$ or $1.25 \leqq Dn50/Dn25 \leqq 1.50$.

Japanese Unexamined Patent Publication JP-A 2005-234410 discloses, in a toner containing at least a polyester resin, a colorant, a release agent, hydrophobic silica and titanium oxide, a technique of dispersing a wax component into the resin to be island shaped; setting quantity of wax present in the vicinity of toner particle surface to 2% by weight to 10% by weight of all the components contained in the toner which figure is a measurement value according to the all-reflection infrared spectroscopy; setting the volume average particle size (Dv) of the toner to 4.0 μm to 6.0 μm; and setting the shape factor SF-1 of the toner particles to 140 to 200, to thereby maintain favorable fluidity of the toner and form a high-quality image having no fog.

In the invention disclosed in JP-A 7-199520, the size difference between smaller particles and larger particles of the charge control agent in the particle size distribution is effective for the long-term charging stability while it is difficult to sufficiently charge the toner of small particles immediately after toner replenishment.

In the invention disclosed in JP-A 9-114127, the particle size distribution is set to $D_{50P}/D_{84P} \leqq 1.45$ or $1.25 \leqq Dn50/Dn25 \leqq 1.50$. In a condition with such particle size distribution, a content of fine toner particles having a volume average particle size of 4 μm or less is not sufficient and it is therefore impossible to form an image having sufficiently high definition and high resolution.

In the invention disclosed in JP-A 2005-234410, the quantity of wax present in the vicinity of toner particle surface is high, to be specific, 2% by weight to 10% by weight of all the components contained in the toner, leading to lower fluidity and incapability of controlling charge on each toner particle, with the result that the fog cannot be suppressed on the non-image part. Moreover, only the volume average particle size is specified, and it is therefore not possible to obtain an image having sufficiently high definition and high resolution. In the region where SF-1 is large, a transferring property is a major issue.

SUMMARY OF THE INVENTION

The invention has been made in view of the above problems, and an object of the invention is to provide a toner capable of forming a high-quality image with high definition and high resolution owing to high fluidity and no occurrence of fog on a non-image part, and a two-component developer, a developing device, and an image forming apparatus using the same.

The invention provides a toner comprising toner particles containing at least a binder resin, colorant, and a release agent, the toner particles having a volume average particle size of 3.0 μm to 6.0 μm of which 5.0 μm or smaller particles make up 40% by number or more and 8.0 μm or larger particles make up less than 2% by volume, and the release agent being a petroleum-based release agent and present in a toner particle surface in amount of 0.7% by weight or more and 1.8% by weight or less.

Further, in the invention, it is preferable that the release agent present in the toner particle surface is 1.0% by weight or more and 1.8% by weight or less.

Further, in the invention, it is preferable that the toner particles have an average degree of circularity of 0.950 or more and 0.960 or less.

Further, in the invention, it is preferable that the release agent has a melting temperature of 70° C. or more.

Further, in the invention, it is preferable that the petroleum-based release agent is a paraffin-based release agent.

Further, in the invention, it is preferable that an external additive is contained in an amount of 2.0 parts by weight or more and less than 4.0 parts by weight based on 100 parts by weight of the toner particles.

Further, the invention provides a two-component developer containing the above toner and a carrier.

Further, in the invention, it is preferable that the carrier has a volume average particle size of 50 μm or less.

Further, the invention provides a developing device performing development by use of the above two-component developer.

Further, the invention provides an image forming apparatus having the above developing device.

According to the invention, in the toner composed toner particles containing at least a binder resin, colorant, and a release agent, the toner particles has a volume average particle size of 3.0 μm to 6.0 μm of which 5.0 μm or smaller particles make up 40% by number or more and 8.0 μm or larger particles make up less than 2% by volume. Further, a content of the release agent in the toner particle surface is 0.7% by weight or more and 1.8% by weight or less. A particularly preferable content of the release agent in the toner particle surface is 1.0% by weight or more and 1.8% by weight or less.

When the content of the release agent in the toner particle surface is set to fall within the above range, the content of the release agent is proper, with the result that even the toner having small particles with a large amount of fine particles is favorable in fluidity, and the charge on each toner particle can also be controlled properly, which makes it possible to form a high-quality image having high definition and high resolution without the fog on non-image parts that is a problem imposed by the decrease in size of toner particles.

In the case where the amount of the release agent in the toner particle surface is less than 0.7% by weight, a required amount of the release agent is not eluted when the toner is being fixed, resulting in a fixing failure and high-temperature offset. In the case where the amount of the release agent in the toner particle surface exceeds 1.8% by weight, the toner has lower fluidity, and the charge on each toner particle cannot be controlled properly, resulting in occurrence of fog on a non-image part.

By setting particle size distribution and particle number distribution of the toner particles within predetermined ranges, the toner can be prevented from spattering, which allows for formation of a high-quality image having high definition and high resolution. When toner particles have a volume average particle size of less than 3.0 μm, the toner will spatter. When toner particles have a volume average particle size exceeding 6.0 μm, it is not possible to form an image having sufficiently high definition and high resolution. When a content of 5.0 μm or smaller toner particles in a toner is less than 40% by number, the toner cannot form an image having sufficiently high definition and high resolution. When a content of 8.0 μm or larger toner particles in a toner is 2% by volume or more, the toner cannot form an image having sufficiently high definition and high resolution.

According to the invention, the toner particles are set to have an average degree of circularity of 0.950 or more and 0.960 or less, with the result that the fog can be further suppressed and the cleaning property is not impaired, thus allowing for formation of a high-quality image.

According to the invention, a melting temperature of the release agent is set to be 70° C. or more, allowing for formation of a high-quality image in which the fog is suppressed with the toner preservation stability not impaired.

According to the invention, the release agent is a petroleum-based release agent, preferably a paraffin-based release agent, allowing for formation of a high-quality image in which the fog is suppressed while the toner preservation stability is not impaired.

According to the invention, a content of an external additive is set to be 2.0 parts by weight or more and less than 4.0 parts by weight based on 100 parts by weight of the toner particles, with the result that the toner has more favorable fluidity and the charge on each toner particle can be controlled properly, therefore allowing for formation of a high-quality image in which the fog is suppressed. When a content of the external additive is less than 2.0 parts by weight, a small toner, especially a toner having a large amount of fine particles, has lowered fluidity and furthermore, due to its large surface area, the small amount of the external additive will result in production of insufficient effect of the external additive. This results in insufficient charging of each toner particle in the developer and easily causes the fog on the non-image part. Moreover, when a content of the external additive is 4.0 parts by weight or more, particles of the external additive will aggregate more easily and therefore be not able to efficiently cover the toner particle surface, thus failing to increase the fluidity, with the result that each toner particle will not be sufficiently charged in the developer, which easily causes the fog on a non-image part.

According to the invention, the two-component developer contains the above toner and a carrier, with the result that the charge on each toner particle can be properly controlled, thereby allowing for formation of a high-quality image having no fog on a non-image part.

According to the invention, the carrier has a volume average particle size of 50 μm or less, with the result that the toner and the carrier come into contact with each other more frequently and that the charge on each other particle can be controlled properly, thereby allowing for formation of a high-quality image in which the fog is further suppressed on the non-image part.

According to the invention, the above two-component developer is used to perform development, thereby allowing for formation of a high-quality toner image having no fog on a non-image part.

According to the invention, an image forming apparatus has the above developing device, thereby allowing for formation of a high-quality image having no fog on a non-image part.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
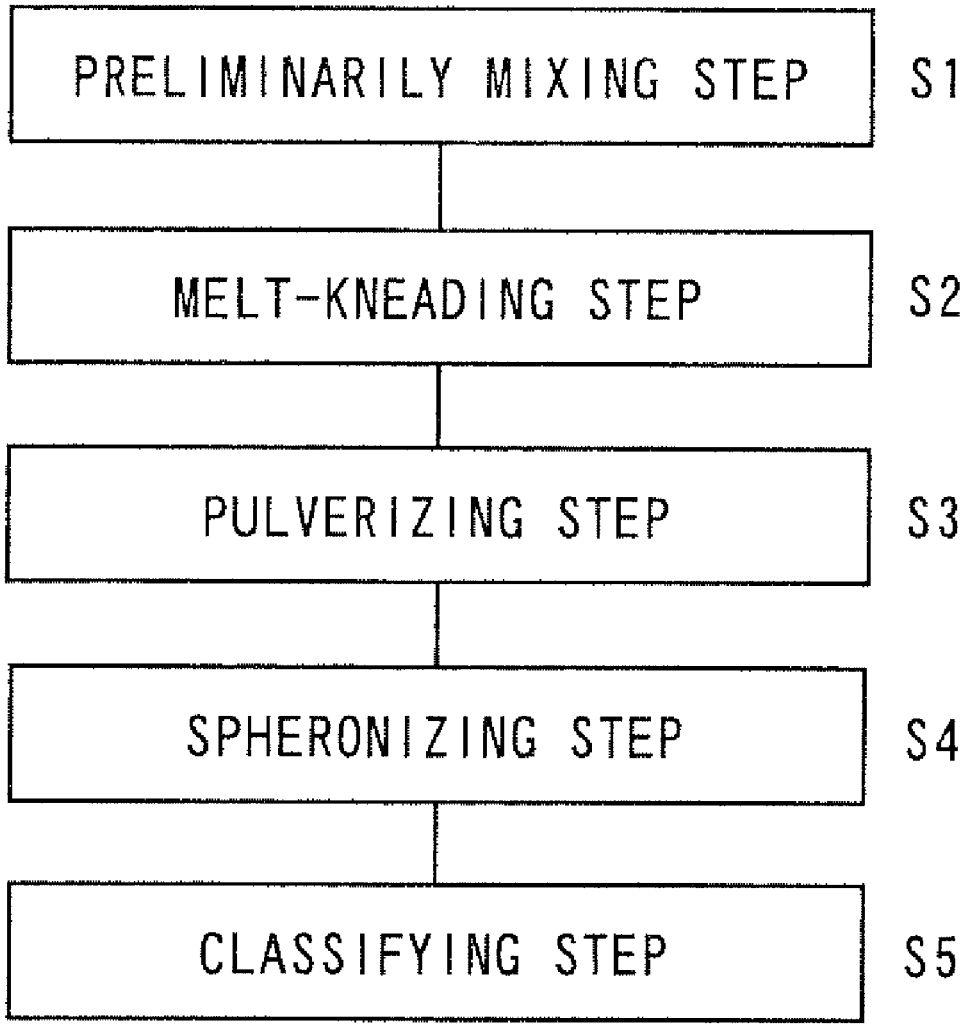
FIG. 1 is a flowchart showing one example of procedure in a method of manufacturing a toner of the invention.

Now referring to the drawings, preferred embodiments of the invention are described below.

A toner of the invention is composed of toner particles which contain at least a binder resin, colorant, and a release agent. The toner particles have a volume average particle size of 3.0 μm to 6.0 μm of which 5.0 μm or smaller particles make up 40% by number or more and 8.0 μm or larger particles make up less than 2% by volume, and an amount of the release agent in toner particle surface is 0.7% by weight or more and 1.8% by weight or less. In particular, the amount of the release agent in the toner particle surface is preferably 1.0% by weight or more and 1.8% by weight or less.

By setting particle size distribution and particle number distribution of the toner particles within predetermined ranges, the toner can be prevented from spattering, which allows for formation of a high-quality image having high definition and high resolution.

For the toner particles having a volume average particle size of 5.0 μm or less, an amount thereof to be used is 40% by number or more because the amount less than 40% by number makes it difficult to form a higher-quality image. On the other hand, the amount exceeding 55% by number will make the toner spatter, and therefore the amount of 55% by number or less is preferred. Further, for the toner particles having a volume average particle size of 8.0 μm or more, an amount thereof is preferably less than 2% by volume because the amount of 2% or more makes it difficult to form a higher-quality image.

By setting the amount of the release agent in the toner particle surface within the above range, the amount of the release agent becomes proper so that even a small toner having a large amount of fine particles has favorable fluidity and that the charge on each toner particle can be controlled properly, which makes it possible to form a high-quality image having high definition and high resolution without the fog on non-image parts that is a problem imposed by the decrease in size of toner particles.

Now, the amount of the release agent in the toner particle surface indicates the amount of the release agent contained in a surface layer region which is within 700 nm deep below the toner particle surface.

In the case where the amount of the release agent in the toner particle surface is less than 0.7% by weight, a required amount of the release agent is not eluted when the toner is being fixed, resulting in a fixing failure and high-temperature offset. In the case where the amount of the release agent in the toner particle surface exceeds 1.8% by weight, the toner has lower fluidity, and the charge on each toner particle cannot be controlled properly, resulting in occurrence of fog on a non-image part.

In the invention, the amount of the release agent in the toner particle surface is estimated from a difference of heat capacity between a toner which has been treated with the elusion process that liquates the release agent in the toner particle surface cut with such a solvent that only a release agent is dissolvable (readily-soluble), and a toner which has not been treated with the elusion process. Heat capacity of a toner (the content of the release agent in the toner) was measured by using a differential scanning calorimeter: DSC220 (trade name) manufactured by Seiko Electronics Inc. To be specific, 1 g of a sample was heated from 20° C. to 150° C. at a temperature increase rate of 10° C./min, following rapid cooling from 150° C. to 20° C., a sequence of which operation was repeated twice, thus forming a DSC curve. The content of the release agent was calculated based on melting heat quantity of the DSC curve measured at the second operation.

Further, in the toner of the invention, by setting the toner particles to have an average degree of circularity of 0.950 or more and 0.960 or less, the degree of circularity becomes proper, with the result that the fog, which is a problem imposed by the decrease in size of toner particles, is further suppressed and that the cleaning property is not impaired, thus allowing for formation of a high-quality image.

In the invention, the volume average particle size ($D_{50v}$) and the content (% by volume, % by number) are measured by a particle size distribution-measuring device: MULTISIZER III (trade name) manufactured by Beckman Coulter, Inc. Measurement conditions are as follows.

Aperture diameter: 100 μm

Number of measured particles: 50,000 counts

Analysis software: COULTER MULTISIZER ACCUCOMP 1.19 version (manufactured by Beckman Coulter, Inc.)

Electrolyte: ISOTON II (manufactured by Beckman Coulter, Inc.)

Dispersant: sodium alkylether sulfate

Procedure for the measurement is as follows. In a beaker, 50 ml of the electrolyte, 20 mg of the sample, and 1 ml of the dispersant are put and then treated with a three-minute dispersion process in an ultrasonic disperser, thereby preparing a measurement sample of which particle size is measured by the above measurement device MULTISIZER III. From a measurement result thus obtained, volume particle size distribution and number particle size distribution of the sample particles are determined. From the volume particle size distribution, the volume average particle size ($D_{50v}$) is determined, and from the number particle size distribution, the content (% by number) of the fine toner particles is determined.

Further, the degree of circularity (ai) of the toner particles is defined by the following expression (1). The degree of circularity (ai) of the toner particles as defined by the expression (1) can be determined, for example, by using a flow particle image analyzer: FPIA-3000 manufactured by Sysmex Corporation. The degree of circularity of the toner particles in the invention corresponds to an average degree of circularity (a) which is a mean value of "m" pieces of the toner particles, and determined by the following expression (2) for computation. To be specific, a sum of respective degrees of circularity (ai) of "m" pieces of toners is obtained first, and the sum is then divided by the number of the toner particles, i.e., the number "m". An arithmetic mean value thus obtained is the degree of circularity of the toner of the invention.

$$\text{Degree of circularity}(ai) = (\text{Peripheral length of circle having the same projection area as that of particle image})/(\text{Length of circumference of projection image of particles}) \quad (1)$$

$$\text{Average degree of circularity } (a) = \sum_{i=1}^{m} ai/m \quad (2)$$

In the analyzer FPIA-3000, a simple calculation method is used that the degrees of circularity (ai) of the respective toner particles are determined; thus-obtained degrees 0.40 to 1.00 in circularity (ai) of the respective toner particles are divided into 61 divisions for every 0.01; frequencies for the respective divisions are obtained; and medians and the frequencies for respective divisions are used to determine the average degree or circularity. Since a value of the average degree of circularity thus obtained by the simple calculation method is not so different from a value of the average degree of circularity (a) obtained by the above expression (2) that a difference therebetween can be substantially overlooked, the average degree of circularity obtained by the simple calculation method is regarded as the average degree of circularity (a) defined by the expression (2) in the present embodiment.

A specific method of measuring the average degree of circularity (ai) is as follows.

Dispersion is prepared by dispersing 5 mg of the toner in 10 ml of water having about 0.1 g of surfactant dissolved therein. The dispersion is then irradiated for five minutes with ultrasonic wave which is 20 kHz in frequency and 50 W in outputs, to thereby adjust concentration of toner particles in the dispersion to 5,000 pieces/μL to 20,000 pieces/μL. On the basis of the dispersion, the degrees of circularity (ai) are then measured to determine the average degree of circularity (a) by the analyzer FPIA-3000.

A method of manufacturing the toner of the invention will be explained hereinbelow. FIG. 1 is a flowchart showing one example of the procedure in the method of manufacturing the toner of the invention. As shown in FIG. 1, the method of manufacturing the toner of the invention includes a preliminarily mixing step (Step S1) of mixing at least a binder resin and colorant into an admixture, a melt-kneading step (Step S2) of melt-kneading the admixture into a melt-kneaded product, a pulverizing step (Step S3) of pulverizing the melt-kneaded product into a pulverized product, a spheronizing step (Step S4) of spheronizing the obtained toner particles, and a classifying step (Step S5) of removing excessively pulverized particles and coarse particles from the pulverized product.

The respective manufacturing processes of Step S1 to Step S5 will be explained in detail below.

[Preliminarily Mixing Step]

In preliminary mixing step S1, at least a binder resin, colorant, and a release agent are dry-mixed with each other by a mixer into an admixture. In the toner, other toner additive components may be contained with the binder resin, the colorant, and the release agent. The other toner additive components include a charge control agent. For theses components, ingredients and usage thereof are not particularly limited, and known substances may be used in a commonly-applied amount.

For the mixer used for dry-mixing, a known mixer can be used including, for example, a Henschel-type mixing device such as FMMIXER (trade name) manufactured by Mitsui Mining Co., Ltd., SUPERMIXER (trade name) manufactured by Kawata MEG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

Hereinbelow, the respective toner ingredients used in the mixing step will be explained.

The binder resin to be used in the invention is not particularly limited, and the binder resin for black toner or color toner may be used. Examples of the binder resin include: a polyester resin; a styrene resin such as polystyrene or styrene-acrylic ester copolymer resin; an acrylic resin such as polymethylmethacrylate; a polyolefin resin such as polyethylene; polyurethane; and an epoxy resin. Also usable is a resin obtained by polymerization reaction of an ingredient monomer mixture and the release agent which are mixed with each other. It is preferred that the toner contain the polyester resin. When the polyester resin is contained in the binder resin, the toner will be high in durability with excellent transparency. The binder resin may be used each alone, or two or mere thereof may be used an combination.

Examples of the colorant include yellow toner colorant, magenta toner colorant, cyan toner colorant, and black toner colorant.

The yellow toner colorant includes, for example, organic pigments such as C.I. pigment yellow 1, C.I. pigment yellow 5, C.I. pigment yellow 12, C.I. pigment yellow 15, C.I. pigment yellow 17, C.I. pigment yellow 74, C.I. pigment yellow 93, C.I. pigment yellow 180, and C.I. pigment yellow 185; inorganic pigments such as yellow iron oxide and yellow ocher; nitro dye such as C.I. acid yellow 1; and oil-soluble dye such as C.I. solvent yellow 2, C.I. solvent yellow 6, C.I. solvent yellow 14, C.I. solvent yellow 15, C.I. solvent yellow 19, and C.I. solvent yellow 21, which are all classified according to color index.

The magenta toner colorant includes, for example, C.I. pigment red 49, C.I. pigment red 57, C.I. pigment red 81, C.I. pigment red 122, C.I. solvent red 19, C.I. solvent red 49, C.I. solvent red 52, C.I. basic red 10, and C.I. disperse red 15, which are all classified according to color index.

The cyan toner colorant includes, for example, C.I. pigment blue 15, C.I. pigment blue 16, C.I. solvent blue 55, C.I. solvent blue 70, C.I. direct blue 25, and C.I. direct blue 86.

The black toner colorant includes, for example, carbon black such as channel black, roller black, disk black, gas furnace black, oil furnace black, thermal black, and acetylene black. Among these carbon black, suitable carbon black may be appropriately selected according to design characteristics of the toner to be obtained.

Other than these pigments, a red pigment, a green pigment, and the like may be used. The colorant may be used each alone, and two or more thereof may be used in combination. Further, two or more of the colorants of the same color series may be used together, and one or two or more colorants respectively selected from different color series may also be used together.

The colorant is preferably used in form of a master batch. The master batch of the colorant can be manufactured, for example, by kneading a molten product of synthetic resin and the colorant. For the synthetic resin, a resin is used of the same sort as that of the binder resin of the toner, or used is a resin highly compatible with the binder resin of the toner. A usage ratio of the synthetic resin and the colorant is not particularly limited, and it is preferable that the colorant constitute 30 parts by weight or more and 100 parts by weight or less based on 100 parts of the synthetic resin. The master batch is used, for example, with granulated particles around 2 mm or more and 3 mm or less in diameter.

A content of the colorant in the toner of the invention is not particularly limited, and is preferably 4 parts by weight or more and 20 parts by weight or less based on 100 parts by weight of the binder resin. In the case of using the master batch, a usage of the master batch is preferably adjusted so that a content of the colorant in the toner of the invention falls in the above range. When the usage of the colorant falls in the above range, it is possible to form a favorable image having excellent image quality with sufficient image density and high color appearance.

For the release agent to be used in the invention, a known substance can be used, and a melting temperature of the release agent is preferably 50° C. or more and 150° C. or less and more preferably 70° C. or more.

With the release agent having a melting temperature of 70° C. or more, it is possible to form a high-quality image with its toner preservation stability not impaired. When the melting temperature of the release agent is lower than 50° C., the release agent is molten inside the developing device, possibly leading to aggregation of toner particles and causing defects such as toner filming on a surface of a photoreceptor. When the melting temperature of the release agent exceeds 150° C., the release agent is not able to be eluted in fixing the toner onto a recording medium, which may result in a failure to produce sufficient effects of enhancing an anti-hot offset property. Now, the melting temperature of the release agent indicates a temperature at an endothermic peak corresponding to meltdown of the DSC curve obtained through measurement of differential scanning calorimetry (abbreviated as "DSC").

Types of the release agent to be used in the invention include, but are not particularly limited to, for example, petroleum-based wax such as paraffin wax and derivatives thereof, and microcrystalline wax and derivatives thereof; hydrocarbon-based synthetic wax such as Fischer-Tropsch wax and derivatives thereof, polyolefin wax and derivatives thereof, low-molecular-weight polypropylene wax and derivatives thereof, and polyolefinic polymer wax and derivatives thereof; carnauba wax and derivatives thereof; and ester wax. It is preferable to use a paraffin-based release agent.

By using the paraffin-based release agent, it is possible to form a high-quality image in which the fixing property and the toner preservation stability are balanced.

In the invention, in order to adjust the amount of the release agent in the toner particle surface within the proper range, it is necessary to control its additive amount in the preliminarily mixing step.

To be specific, in order to have the toner particle surface containing the release agent of 0.7% by weight or more and 1.8% by weight or less, the additive amount of the release agent in the preliminarily mixing step is set to be 2.5 parts by weight or more and 6.0 parts by weight or less based on 100 parts by weight of the binder resin. Further, in order to adjust the amount of the release agent in the toner particle surface to fall within a more preferable range, i.e., to be 1.0% by weight or more and 1.8% by weight or less, it is preferable to set the additive amount of the release agent to be 3.0 parts by weight or more and 5.0 parts by weight or less.

The toner of the invention may contain other toner additive components represented by a charge control agent, with the binder resin, the colorant, and the release agent. The addition of the charge control agent gives the toner a favorable charging property. The usable charge control agent includes a positive charge control agent and a negative charge control agent. The positive charge control agent includes, for example, a basic dye, quaternary ammonium salt, guaternary phosphonium salt, aminopyrine, a pyrimidine compound, a polynuclear polyamino compound, aminosilane, a nigrosine dye, a derivative thereof, a triphenylmethane derivative, guanidine salt, and amidine salt. The negative charge control agent includes oil-soluble dyes such as oil black and spiron black, a metal-containing azo compound, an azo complex dye, metal salt naphthenate, salicylic acid, metal complex and metal salt (the metal includes chrome, zinc, and zirconium) of a salicylic acid derivative, a boron compound, a fatty acid soap, long-chain alkylcarboxylic acid salt, and a resin acid soap. The charge control agents may be used each alone, or two or more thereof may be used in combination. A usage of the compatible charge control agent is preferably 0.5 part by weight or more and 5 parts by weight or less based on 100 parts by weight of the binder resin, and more preferably 0.5 part by weight or more and 3 parts by weight or less based on 100 parts by weight of the binder resin. When the content of the charge control agent is larger than 5 parts by weight, a carrier is contaminated, causing the toner to spatter. When the content of the non-compatible charge control agent is less than 0.5 part by weight, the toner is not given a sufficient charging property.

[Melt-kneading Step]

In the melt-kneading step S2, the admixture prepared in the preliminary mixing step is melt-kneaded into a melt-kneaded product. In melt-kneading the admixture, the admixture is heated to a temperature equal to or higher than the softening temperature of the binder resin and lower than the decomposition temperature of the binder resin to thereby melt or soften the binder resin in which the toner ingredients other than the binder resin will be then dispersed.

For the kneading device, a known device can be used including, for example, a twin-screw extruder, a three roll mill, and a laboplast mill. Specific examples of such a kneading device include single or twin screw extruders such as TEM-100B (trade name) manufactured by Toshiba Machine Co., Ltd., and PCM-65/87 and PCM-30, both of which are trade names and manufactured by Ikegai Ltd., and open roll-type kneading machines such as KNEADEX (trade name) manufactured by Mitsui Mining Co., Ltd. Among these kneaders, the open roll-type kneading machines are preferred. The admixture of the toner ingredients may be melt-kneaded by using a plurality of the kneading devices.

[Pulverizing Step]

In the pulverizing step S3, the melt-kneaded product obtained in the melt-kneading step is cooled to be solidified and then pulverized into a pulverized product. The melt-kneaded product cooled and solidified is firstly pulverized by a hammer mill, a cutting mill, or the like device, into a coarsely pulverized product having a volume average particle size of around 100 μm or more and 5 mm or less, for example. After that, the coarsely pulverized produce thus obtained is furthermore pulverized into a finely pulverized product having a volume average particle size of 15 μm or less, for example. For finely pulverizing the coarsely pulverized product, usable are, for example, a jet-type pulverizer using supersonic jet stream for the pulverization, and an impact-type pulverizer in which the coarsely pulverized product is introduced into a space formed between a rotor rotating at high speed and a stator (linear) and then pulverized therein.

Note that the melt-kneaded product cooled and solidified may be directly pulverized by the jet-type pulverizer, the impact-type pulverizer, or the like device, without coarse pulverization by means of the hammer mill, the cutting mill, or the like device.

In the invention, the particle size distribution and particle number distribution of the toner are specified, and in the pulverizing step, these can be controlled by adjusting an amount of supply air in the case of a pulverizer using air or by adjusting a rotor rotation speed in the case of a pulverizer using a rotor.

[Spheronizing Step]

In the spheronizing step S4, particles of the pulverized product prepared in the pulverizing step are spheronized by use of mechanical impact or hot air. By shperonizing the particles of pulverized product, the average degree of circularity and circularity distribution of the toner particles can be controlled, so that the toner particle can be formed into a favorable shape. Accordingly, the toner thus manufactured is capable of maintaining transfer efficiency at high level and stably forming high-quality images.

In the case where no spheronizing step is provided, the content of irregular toner particles will be high, which may decrease the transfer efficiency and fail to stably form high-quality images.

Examples of the spheronization processing method include a spheronizing method using mechanical impact and a spheronizing method using hot air.

A usable example of the impact-type spheronizing device for the spheronizing method using mechanical impact is a commercially-available device including FACULTY (trade name) manufactured by Hosokawa Micron Corporation.

As the hot-air-type spheronizing device for the spheronizing method using hot air may be used commercially-available apparatuses including a surface modifying system: METEO-RAINBOW (trade name) manufactured by Nippon Pneumatic MFG. Co., Ltd.

When the mechanical impact or hot air is used for the spheronization process in the spheronizing step as above, the average degree of circularity and circularity distribution of the toner particles can be easily controlled, with the result that the toner particle can be more easily formed into a favorable shape. Consequently, the toner thus manufactured is capable of more easily maintaining the transfer efficiency at high level and stably forming high-quality images.

[Classifying Step]

In the classifying step S5, excessively pulverized toner particles and coarse toner particles are removed from the spheronized toner particles by a classifier. The excessively pulverized toner particles and the coarse toner particles will be collected and able to be reused for manufacture of another toner.

For the classification, a known classifier is usable by which the excessively pulverized toner particles and the coarse toner particles can be removed through classification using centrifugal force or wind force. The known classifier includes, for example, a swivel pneumatic classifier (rotary pneumatic classifier).

It is preferable that classification conditions in the classifying step be appropriately adjusted so as to obtain toner particles having a volume average particle size of 3.0 μm to 6.0 μm after the classification. When the volume average particle size of the toner particles is smaller than 3.0 μm, the fluidity and the transfer efficiency may deteriorate, and the toner may spatter or the fog may appear, and what is worse, the cleaning property may also deteriorate. And in this case, it may also become difficult to manufacture the toner. When the volume average particle size of the toner particles exceeds 6.0 μm, the volume average particle size of the toner particles may be too large to form a high-resolution image.

The above-stated classification conditions to be adjusted include, for example, a rotation speed of a classification rotor in the swivel pneumatic classifier (rotary pneumatic classifier).

Completion of the classifying step indicates the end of the process of manufacturing the toner of the invention.

The spheronizing step S4 and the classifying step S5 may be conducted at the same time or in reverse order depending on a type of device for use in the spheronizing step.

With the toner manufactured as above, an external additive may be mixed having functions such as enhancing powder fluidity, enhancing frictional changeability, enhancing heat resistance, improving long-term preservation stability, improving a cleaning property, and controlling a wear characteristic of photoreceptor surface. Examples of the external additive include fine silica powder, fine titanium oxide powder, and fine aluminum powder. The external additive may be used each alone, or two or more thereof may be used in combination. An amount of the external additive to be added is preferably 0.1 part by weight or more and 10 parts by weight or less and more preferably 2.0 parts by weight or more and less than 4.0 parts by weight based on 100 parts by weight of the toner particles in view of charge quantity required for the toner, influence on photoreceptor wear through addition of the external additive, environmental characteristics of the toner, and the like elements.

When the toner particle contains the external additive of 2.0 parts by weight or more and less than 4.0 parts by weight, the toner can be given more favorable fluidity and the charge on each toner particle can be controlled properly, thus allowing for formation of a high-quality image having the fixing property not impaired and not suffering from the fog which is a problem imposed by the decrease in size of toner particles.

When the content of the external additive is less than 2.0 parts by weight, the toner having small particles, especially the toner having a large amount of fine particles, has lowered fluidity and furthermore, due to its large surface area, the small amount of the external additive will result in production of insufficient effect of the external additive. This results in insufficient charging of each toner particle in the developer and easily causes the fog on the non-image part. Moreover, when a content of the external additive is 4.0 parts by weight or more, particles of the external additive will aggregate more easily and therefore be not able to efficiently cover the toner particle surface, thus failing to increase the fluidity, with the result that each toner particle will not be sufficiently charged in the developer, which easily causes the fog on the non-image part.

The toner of the invention manufactured as above can be used as one-component developer without change and can also be mixed with a carrier to be used in form of two-component developer.

The two-component developer containing the toner of the invention has respective toner particles properly charged and therefore is capable of forming a high-quality image having no fog on the non-image part.

For the carrier constituting the two-component developer, magnetic particles can be used. Specific examples of the magnetic particles include metals such as iron, ferrite, and magnetite; and alloys composed of the metals just cited and metals such as aluminum or lead. Among these examples, ferrite is preferred.

Further, the carrier can be a resin-coated carrier in which the magnetic particles are coated with resin, or a dispersed-in-resin carrier in which the magnetic particles are dispersed in resin. The resin for coating the magnetic particles includes, but is not particularly limited to, for example, an olefin-based resin, a styrene-based resin, a styrene-acrylic resin, a silicone-based resin, an ester-based resin, and a fluorine-containing polymer-based resin. The resin used for the dispersed-in-resin carrier includes, but is not particularly limited either to, for example, a styrene-acrylic resin, a polyester resin, a fluorine-based resin, and a phenol resin.

A shape of the carrier is preferably spherical or oblong.

Further, the volume average particle size of the carrier is not particularly limited, and in consideration of enhancement in image quality, it is preferably 10 μm to 100 μm and more preferably 50 μm or less.

By setting the volume average particle size of the carrier to be 50 μm or less, the toner and the carrier come into contact with each other more frequently, and the charge on each other particle can be controlled properly, thereby allowing for formation of a high-quality image having no fog occurring on the non-image part, which fog is a problem imposed by the decrease in size of toner particles.

Furthermore, resistivity of the carrier is preferably $10^8$ Ω·cm or more and more preferably $10^{12}$ Ω·cm or more. The resistivity of the carrier is a value derived from a current value obtained in a manner that the carrier is put in a container having a sectional area of 0.50 $cm^2$ followed by tapping, and a load of 1 $kg/cm^2$ is then applied to the particles put in the container, thereafter being subjected to application of voltage which generates an electric field of 1,000 V/cm between the load and a bottom electrode. When the resistivity of the carrier is small, application of bias voltage to a developing sleeve will cause the charge to be injected to the carrier, which makes the carrier particles be easily attached to the photoreceptor. Further, in this case, breakdown of the bias voltage occurs more easily.

Magnetization intensity (maximum magnetization) of the carrier is preferably 10 emu/g to 60 emu/g and more preferably 15 emu/g to 40 emu/g. The magnetization intensity depends on magnetic flux density of the developing roller. Under a condition that the developing roller has normal magnetic flux density, the magnetization intensity less than 10 emu/g will lead to a failure to exercise magnetic binding force, which may cause the carrier to be spattered. When the magnetization intensity exceeds 60 emu/g, it becomes difficult to keep a noncontact state with an image bearing member in a noncontact development where brush of the carrier is too high, and in a contact development, sweeping patterns may appear more frequently in a toner image.

A use ratio between the toner and the carrier contained in the two-component developer is not particularly limited and may be appropriately selected according to kinds of the toner and the carrier. To take the case of the resin-coated carrier (having density of 5 $g/cm^2$ to 8 $g/cm^2$) as an example, it is preferable to use the toner in such an amount that the content of the toner in the two-component developer is 2% by weight to 30% by weight and preferably 2% by weight to 20% by weight, of a total amount of the two-component developer. Further, in the two-component developer, the coverage of the toner over the carrier is preferably 40% to 80%.

Figure 2:
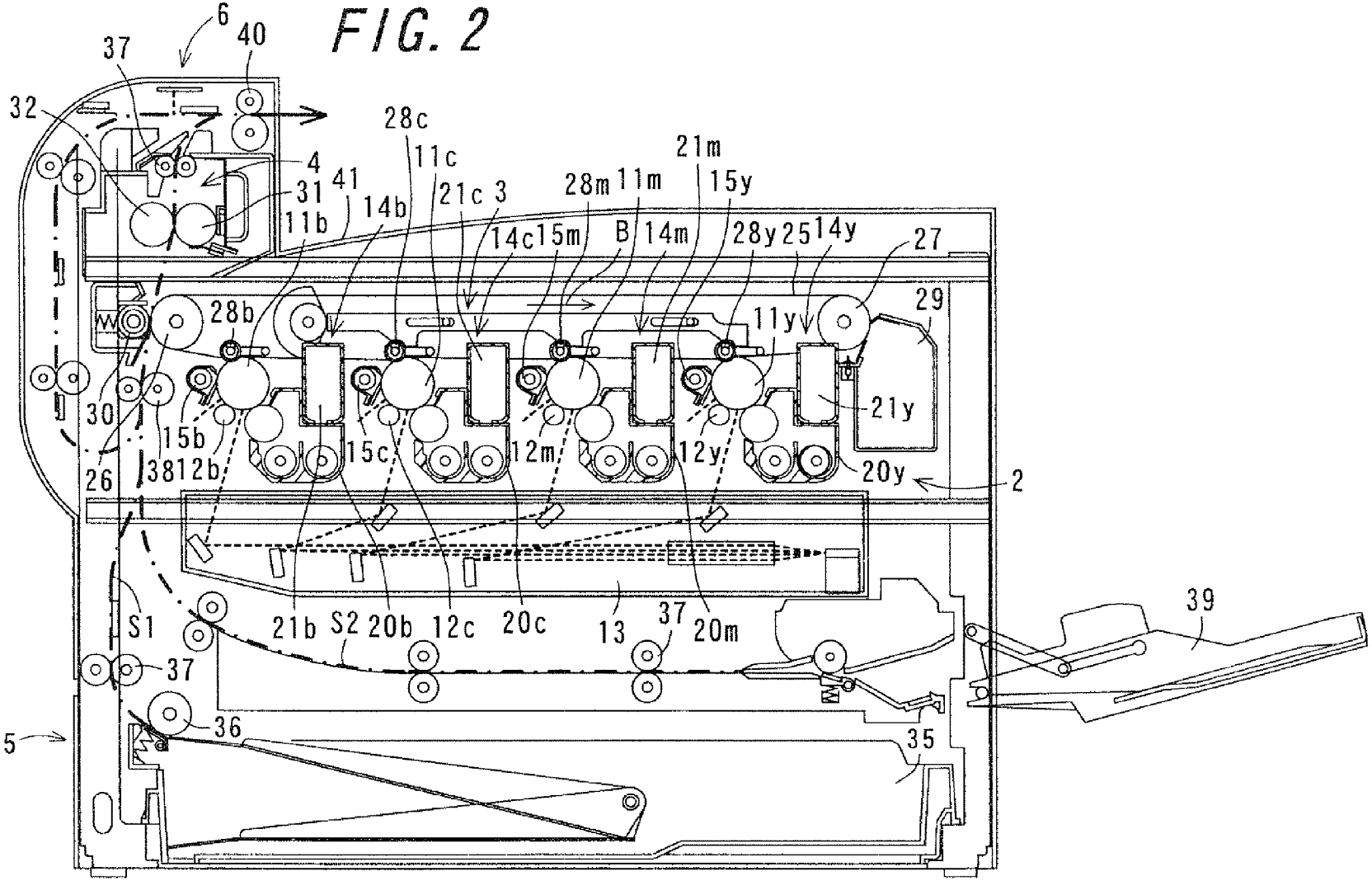
FIG. 2 is a schematic view showing constitution of an image forming apparatus according to an embodiment of the invention.

FIG. 2 is a schematic view showing constitution of an image forming apparatus according to an embodiment of the invention. The image forming apparatus is a multifunction, printer having a copier function, a printer function, and a facsimile function together, and according to image information being conveyed to the image forming apparatus, a full-color or monochrome image is formed on a recording medium. That is, the image forming apparatus has three types of print mode, i.e., a copier mode, a printer mode and a FAX mode, and the print mode is selected by a control unit (not shown) in accordance with, for example, the operation input from an operation portion (not shown) and reception of the printing job from, external equipment such as a personal computer, a mobile device, an information recording storage medium, and a memory device. The image forming apparatus includes a toner image forming section 2, a transferring section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the toner image forming section 2 and some parts of the components contained in the transferring section 3. The four sets of respective components provided for the respective colors are distinguished herein by giving alphabets indicating the respective colors to the end of the reference numerals, and in the case where the sets are collectively referred to, only the reference numerals are shown.

The toner image forming section 2 includes a photoreceptor drum 11, a charging section 12, an exposure unit 13, a developing device 14, and a cleaning unit 15. The charging section 12, the developing device 14, and the cleaning unit 15 are disposed around the photoreceptor drum 11 in the order just stated. The charging section 12 is disposed vertically below the developing device 14 and the cleaning unit 15.

The photoreceptor drum 11 is rotatably supported around an axis thereof by a driving section (not shown) and includes a conductive substrate, (not shown) and a photosensitive layer (not shown) formed on a surface of the conductive substrate. The conductive substrate may be formed into various shapes such as a cylindrical shape, a circular columnar shape, and a thin film sheet shape. Among these shapes, the cylindrical shape is preferred. The conductive substrate is formed of a conductive material. As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, etc. is formed on a film-like substrate such as a synthetic resin film, a metal film, and paper; and a resin composition containing at least conductive particles and/or conductive polymers. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer has a smooth surface, that chargeability of the photosensitive layer can be prevented from degrading during repetitive use, and that the charging property of the photosensitive layer can be enhanced under a low temperature circumstance and/or a low humidity circumstance. Further, the photosensitive layer may be a laminated photoreceptor having a highly-durable three-layer structure in which a photoreceptor surface-protecting layer is provided on the top layer.

The charge generating layer contains as a main ingredient a charge generating substance that generates charge under irradiation of light, and optionally contains known binder resin, plasticizer, sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generating ability and are suitable for forming a highly-sensitive photosensitive layer. The charge generating substances may be used each alone, or two or more of them may be used in combination. The content of the charge generating substance is not particularly limited, and preferably from 5 parts by weight to 500 parts by weight and more preferably from 10 parts by weight to 200 parts by weight based on 100 parts by weight of the binder resin in the charge generating layer. Also as the binder resin for charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyallylate, polyamide, and polyester. The binder resins may be used each alone or, optionally, two or more of them may be used in combination.

The charge generating layer can be formed by dissolving or dispersing an appropriate amount of a charge generating substance, a binder resin and, optionally, a plasticizer, a sensitizer, etc. respectively in an appropriate organic solvent in which the ingredients described above are dissolvable or dispersible, to thereby prepare a coating solution for charge generating layer, and then applying the coating solution for charge generating layer to the surface of the conductive substrate, followed by drying. The thickness of the charge generating layer obtained in this way is not particularly limited, and preferably from 0.05 μm to 5 μm and more preferably from 0.1 μm to 2.5 μm.

The charge transporting layer stacked over the charge generating layer contains as essential ingredients a charge transporting substance having an ability of receiving and transporting the charge generated from the charge generating substance, and a binder resin for charge transporting layer, and optionally contains known antioxidant, plasticizer, sensitizer, lubricant, etc. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl)anthracene, 1,1-bis(4-dibenzylaminophenyl) propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, bromanil, chloranil, and benzoquinone. The charge transporting substances may be used each alone, or two or more of them may be used in combination. The content of the charge transporting substance is not particularly limited, and preferably from 10 parts by weight to 300 parts by weight and more preferably from 30 parts by weight to 150 parts by weight based on 100 parts by weight of the binder resin in the charge transporting substance. As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, an epoxy resin, polyurethane, polyvinylketone, polystyrene, polyacrylamide, a phenolic resin, a phenoxy resin, a polysulfone resin, and a copolymer resin thereof. Among those materials, in view of the film forming property, and the wear resistance, an electrical property etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resins may be used each alone, or two or more of them may be used in combination.

The charge transporting layer preferably contains an antioxidant together with the charge transporting substance and the binder resin for charge transporting layer. Also for the antioxidant, materials used customarily in the relevant field can be used including, for example, Vitamin E, hydroquinone, hindered amine, hindered phenol, paraphenylene diamine, arylalkane, and derivatives thereof, an organic sulfur compound, and an organic phosphorus compound. The antioxidants may be used each alone, or two or more of them may be used in combination. The content of the antioxidant is not particularly limited, and is 0.01% by weight to 10% by weight and preferably 0.05% by weight to 5% by weight of the total amount of the ingredients constituting the charge transporting layer. The charge transporting layer can be formed by dissolving or dispersing an appropriate amount of a charge transporting substance, a binder resin and, optionally, an antioxidant, a plasticizer, a sensitizer, etc. respectively in an appropriate organic solvent which is capable of dissolving or dispersing the ingredients described above, to thereby prepare a coating solution for charge transporting layer, and applying the coating solution for charge transporting layer to the surface of a charge generating layer followed by drying. The thickness of the charge transporting layer obtained in this way is not particularly limited, and preferably 10 μm to 50 μm and more preferably 15 μm to 40 μm. Note that it is also possible to form a photosensitive layer in which a charge generating substance and a charge transporting substance are present in one layer. In this case, the kinds and contents of the charge generating substance and the charge transporting substance, the kind of the binder resin, and other additives may be the same as those in the case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like.

The charging section 12 faces the photoreceptor drum 11 and is disposed away from the surface of the photoreceptor drum 11 when viewed in a longitudinal direction of the photoreceptor drum 11. The charging section 12 charges the surface of the photoreceptor drum 11 so that the surface of the photoreceptor drum 11 has predetermined polarity and potential. As the charging section 12, it is possible to use a charging brush type charging device, a charger type charging device, a pin array type charging device, an ion-generating device, etc. Although the charging section 12 is disposed away from the surface of the photoreceptor drum 11 in the embodiment, the configuration is not limited thereto. For example, a charging roller may be used as the charging section 12, and the charging roller may be disposed in pressure-contact with the photoreceptor drum 12. It is also possible to use a contact-charging type charger such as a charging brush or a magnetic brush.

The exposure unit 13 is disposed so that light beams corresponding to each color information emitted from the exposure unit 13 pass between the charging section 12 and the developing device 14 and reach the surface of the photoreceptor drum 11. In the exposure unit 13, the image information is converted into light beams corresponding to each color information of black (b), cyan (c), magenta (m), and yellow (y), and the surface of the photoreceptor drum 11 which has been evenly charged by the charging section 12, is exposed to one light beams corresponding to each color information to thereby form electrostatic latent images on the surfaces of the photoreceptor drums 11. As the exposure unit 13, it is possible to use a laser scanning unit having a laser-emitting portion and a plurality of reflecting mirrors. The other usable examples of the exposure unit 13 may include an LED array and a unit in which a liquid-crystal shutter and a light source are appropriately combined with each other.

Figure 3:
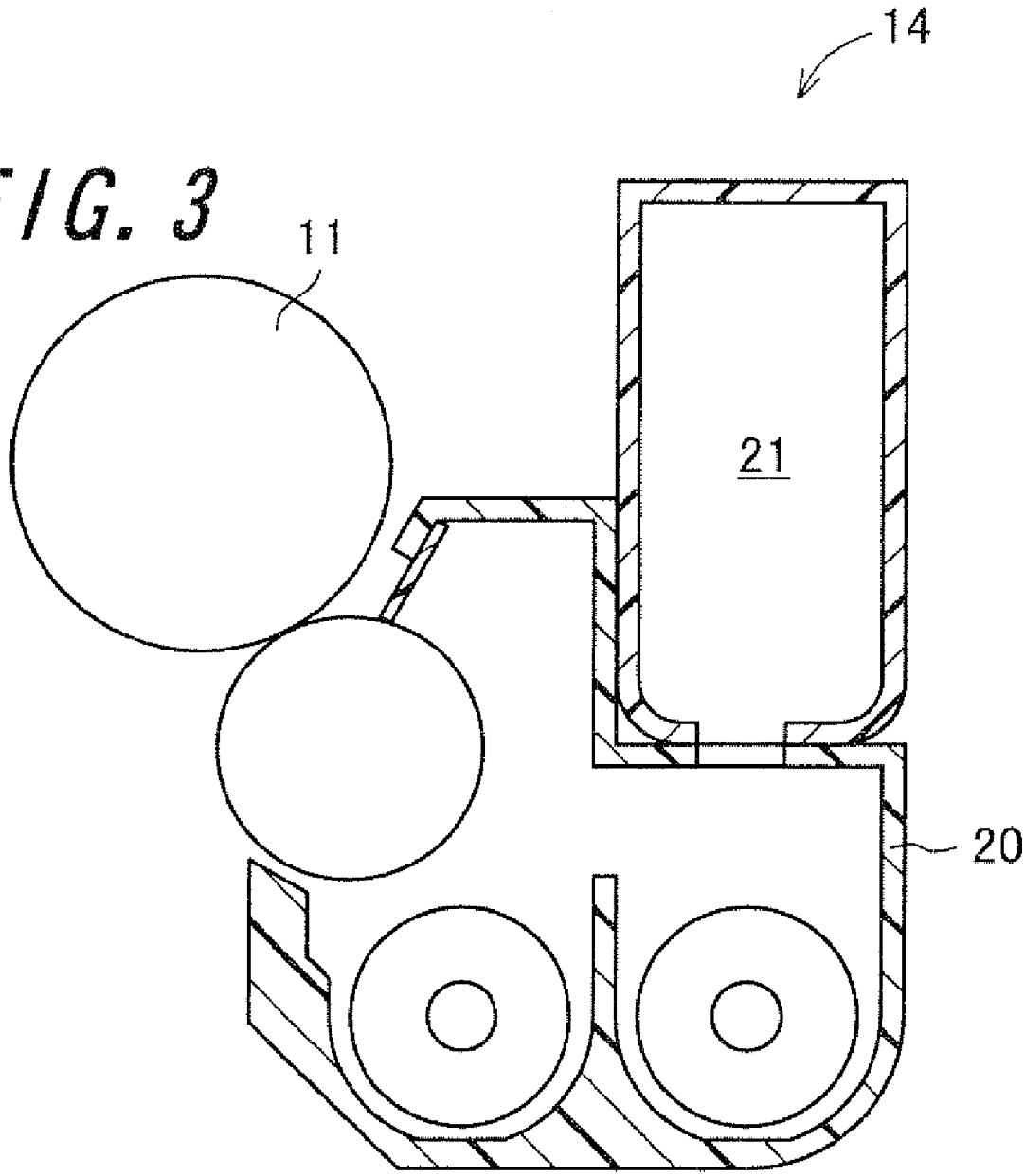
FIG. 3 is a schematic view showing constitution of a developing device according to an embodiment of the invention.

FIG. 3 is a schematic view showing constitution of the developing device 14 according to the embodiment of the invention. The developing device 14 includes a developing tank 20 and a toner hopper 21. The developing tank 20 is a container-shaped member which is disposed so as to face the surface of the photoreceptor drum 11 and used to supply a toner to an electrostatic latent image formed on the surface of the photoreceptor drum 11 so as to develop the electrostatic latent image into a visualized image, i.e. a toner image. The developing tank 20 contains in an internal space thereof the toner, and rotatably supports roller members such as a developing roller, a supplying roller, and an agitating roller, or screw members, which roller or screw members are contained in the developing tank 20. The developing tank 20 has an opening in a side face thereof opposed to the photoreceptor drum 11. The developing roller is rotatably provided at such a position as to face the photoreceptor drum 11 through the opening just stated. The developing roller is a roller-shaped member for supplying a toner to the electrostatic latent image on the surface of the photoreceptor drum 11 in a pressure-contact portion or most-adjacent portion between the developing roller and the photoreceptor drum 11. In supplying the toner, to a surface of the developing roller is applied potential whose polarity is opposite to polarity of the potential of the charged toner, which serves as development bias voltage. By so doing, the toner on the surface of the developing roller is smoothly supplied to the electrostatic latent image. Furthermore, an amount of the toner being supplied to the electrostatic latent image (which amount is referred to as "toner attachment amount") can be controlled by changing a value of the development bias voltage. The supplying roller is a roller-shaped member which is rotatably disposed so as to face the developing roller and used to supply the toner to the vicinity of the developing roller. The agitating roller is a roller-shaped member which is rotatably disposed so as to face the supplying roller and used to feed to the vicinity of the supplying roller the toner which is newly supplied from the toner hopper 21 into the developing tank 20. The toner hopper 21 is disposed so as to communicate a toner replenishment port (not shown) formed in a vertically lower part of the toner hopper 21, with a toner reception port (not shown) formed in a vertically upper part of the developing tank 20. The toner hopper 21 replenishes the developing tank 20 with the toner according to toner consumption. Further, it may be possible to adopt, such configuration that the developing tank 20 is replenished with the toner supplied directly from a toner cartridge of each color without using the toner hopper 21.

The developing device which performs development with use of the two-component developer of the invention, is capable of forming a high-quality toner image that does not suffer from any fog which may be caused on the non-image part on the photoreceptor.

The cleaning unit 15 removes the toner which remains on the surface of the photoreceptor drum 11 after the toner image has been transferred to the recording medium, and thus cleans the surface of the photoreceptor drum 11. In the cleaning unit 15, a platy member is used such as a cleaning blade. In the image forming apparatus of the invention, an organic photoreceptor drum is mainly used as the photoreceptor drum 11. A surface of the organic photoreceptor drum contains a resin component as a main ingredient and therefore tends to be degraded by chemical action of ozone which is generated by corona discharging of a charging device. The degraded surface part is, however, worn away by abrasion through the cleaning unit 15 and thus removed reliably, though gradually. Accordingly, the problem of the surface degradation caused by the ozone, etc. is actually solved, and the potential of charge given in the charging operation can be thus maintained stably for a long period of time. Although the cleaning unit 15 is provided in the embodiment, no limitation is imposed on the configuration and the cleaning unit 15 does not have to be provided.

In the toner image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing device 14 to the electrostatic latent image, thereby forming a toner image; the toner image is transferred to an intermediate transfer belt 25; and the toner which remains on the surface of the photoreceptor drum 11 is removed by the cleaning unit 15. A series of the toner image forming operations just described is repeatedly carried out.

The transferring section 3 is disposed above the photoreceptor drum 11 and includes the intermediate transfer belt 25, a driving roller 26, a driven roller 27, intermediate transferring rollers 28*b*, 28*c*, 28*m*, 28*y*, a transfer belt cleaning unit 29, and a transferring roller 30. The intermediate transfer belt 25 is an endless belt stretched between the driving roller 26 and the driven roller 27, thereby forming a loop-shaped travel path. The intermediate transfer belt 25 rotates in an arrow B direction. When the intermediate transfer belt 25 passes by the photoreceptor drum 11 in contact therewith, the transfer bias voltage whose polarity is opposite to the polarity of the charged toner on the surface of the photoreceptor drum 11 is applied from the intermediate transferring roller 28 which is disposed opposite to the photoreceptor drum 11 across the intermediate transfer belt 25, with the result that the toner image formed on the surface of the photoreceptor drum 11 is transferred onto the intermediate transfer belt 25. In the case of a multicolor image, the toner images of respective colors formed on the respective photoreceptor drums 11 are sequentially transferred and overlaid onto the intermediate transfer belt 25, thus forming a multicolor toner image. The driving roller 26 can rotate around an axis thereof with the aid of a driving section (not shown), and the rotation of the driving roller 26 drives the intermediate transfer belt 25 to rotate in the arrow B direction. The driven roller 27 can be driven to rotate by the rotation of the driving roller 26, and imparts constant tension to the intermediate transfer belt 25 so that the intermediate transfer belt 25 does not go slack. The intermediate transferring roller 28 is disposed in pressure-contact with the photoreceptor drum 11 across the intermediate transfer belt 25, and capable of rotating around its own axis by a driving section (not shown). The intermediate transferring roller 28 is connected to a power source (not shown) for applying the transfer bias voltage as described above, and has a function of transferring the toner image formed on the surface of the photoreceptor drum 11 to the intermediate transfer belt 25. The transfer belt cleaning unit 29 is disposed opposite to the driven roller 27 across the intermediate transfer belt 25 so as to come into contact with an outer circumferential surface of the intermediate transfer belt 25. The residual toner which is attached to the intermediate transfer belt 25, which is caused by contact of the intermediate transfer belt 25 with the photoreceptor drum 11, may cause contamination on a reverse side of the recording medium, the transfer belt cleaning unit 29 removes and collects the toner on the surf ace of the intermediate transfer belt 25. The transferring roller 30 is disposed in pressure-contact with the driving roller 26 across the intermediate transfer belt 25, and capable of rotating around its own axis by a driving section (not shown). In a pressure-contact portion (a transfer nip portion) between the transferring roller 30 and the driving roller 26, a toner image which has been carried by the intermediate transfer belt 25 and thereby conveyed to the pressure-contact portion is transferred onto a recording medium fed from the later-described recording medium feeding section 5. The recording medium bearing the toner image is fed to the fixing section 4. In the transferring section 3, the toner image is transferred from the photoreceptor drum 11 onto the intermediate transfer belt 25 in the pressure-contact portion between the photoreceptor drum 11 and the intermediate transferring roller 28, and by the intermediate transfer belt 25 rotating in the arrow B direction, the transferred toner image is conveyed to the transfer nip portion where the toner image is transferred onto the recording medium.

The fixing section 4 is provided downstream of the transferring section 3 along a conveyance direction of the recording medium, and contains a fixing roller 31 and a pressure roller 32. The fixing roller 31 can rotate by a driving section (not shown), and heats the toner constituting an unfixed toner image borne on the recording medium so that the toner is fused to be fixed on the recording medium. Inside the fixing roller 31 is provided a heating portion (not shown). The heating portion heats the heating roller 31 so that a surface of the heating roller 31 has a predetermined temperature (heating temperature). For the heating portion, a heater, a halogen lamp, and the like device can be used, for example. The heating portion is controlled by the later-described fixing condition controlling portion. In the vicinity of the surface of the fixing roller 31 is provided a temperature detecting sensor which detects a surface temperature of the fixing roller 31. A result detected by the temperature detecting sensor is written to a memory portion of the later-described control unit. The pressure roller 32 is disposed in pressure-contact with the fixing roller 31, and supported so as to be rotatably driven by the rotation of the fixing roller 31. The pressure roller 32 helps the toner image to be fixed onto the recording medium by pressing the toner and the recording medium when the toner is fused to be fixed on the recording medium by the fixing roller 31. A pressure-contact portion between the fixing roller 31 and the pressure roller 32 is a fixing nip portion. In the fixing section 4, the recording medium onto which the toner image has been transferred in the transfer section 3 is nipped by the fixing roller 31 and the pressure roller 32 so that when the recording medium passes through the fixing nip portion, the toner image is pressed and thereby fixed onto the recording medium under heat, whereby an image is formed.

The recording medium feeding section 5 includes an automatic paper feed tray 35, a pickup roller 36, conveying rollers 37, registration rollers 38, and a manual paper feed tray 39. The automatic paper feed tray 35 is disposed in a vertically lower part of the image forming apparatus and in form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path S1. The conveying rollers 37 are a pair of roller members disposed in pressure-contact with each other, and convey the recording medium to the registration rollers 38. The registration rollers 38 are a pair of roller members disposed in pressure-contact with each other, and feed to the transfer nip portion the recording medium fed from the conveying rollers 37 in synchronization with the conveyance of the toner image borne on the intermediate transfer belt 25 to the transfer nip portion. The manual paper feed tray 39 is a device storing recording mediums which are different from the recording mediums stored in the automatic paper feed tray 35 and may have any size and which are to be taken into the image forming apparatus, and the recording medium taken in from the manual paper feed tray 39 passes through a paper conveyance path S2 by use of the conveying rollers 37, thereby being fed to the registration rollers 38. In the recording medium feeding section 5, the recording medium supplied sheet by sheet from the automatic paper feed tray 35 or the manual paper feed tray 39 is fed to the transfer nip portion in synchronization with the conveyance of the toner image borne on the intermediate transfer belt 25 to the transfer nip portion.

The discharging section 6 includes the conveying rollers 37, discharging rollers 40, and a catch tray 41. The conveying rollers 37 are disposed downstream of the fixing nip portion along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus. The catch tray 41 stores the recording medium onto which the image has been fixed.

The image forming apparatus includes a control unit (not shown). The control unit is disposed, for example, in an upper part of an internal space of the image forming apparatus, and contains a memory portion, a computing portion, and a control, portion. To the memory portion of the control unit are input, for example, various set values obtained by way of an operation panel (not shown) disposed on the upper surface of the image forming apparatus, results detected from a sensor (not shown) etc. disposed in various portions inside the image forming apparatus, and image information obtained from external equipment. Further, programs for operating various functional elements are written. Examples of the various functional elements include a recording medium determining portion, an attachment amount controlling portion, and a fixing condition controlling portion. For the memory portion, those customarily used in the relevant filed can be used including, for example, a read only memory (ROM), a random access memory (RAM), and a hard disc drive (HDD). For the external equipment, it is possible to use electrical and electronic devices which can form or obtain the image information and which can be electrically connected to the image forming apparatus. Examples of the external, equipment include a computer, a digital camera, a television, a video recorder, a DVD (digital versatile disc) recorder, an HDDVD (high-definition digital versatile disc), a blu-ray disc recorder, a facsimile machine, and a mobile computer. The computing portion of the control unit takes out the various data (such as an image formation order, the detected result, and the image information) written in the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is achieved by a microcomputer, a microprocessor, etc. having a central processing unit (abbreviated as CPU). The control unit contains a main power source as well as the above-stated processing circuit. The power source supplies electricity to not only the control unit but also respective devices provided inside the image forming apparatus.

By using the image forming apparatus of the invention, fog will not be caused on the non-image part, thus allowing for formation of a high-quality image having high resolution and high definition.

EXAMPLES

Hereinafter, the invention will be specifically explained with reference to Examples and Comparative examples.

In Examples and Comparative examples, the following methods were adopted to measure a volume average particle size of toner particles, a coefficient of variation CV, an amount of the release agent in the toner particle surface, an average degree of circularity of toner particles, and the melting temperature of the release agent.

[Volume Average Particle Size of Toner Particles and Coefficient of Variation CV]

A volume average particle size of a toner was determined from the particle size distribution of toner particles measured in the above measurement condition by use of COULTER MULTISIZER III manufactured by Beckman Coulter, Inc.

Further, a coefficient of variation (CV value, %) was determined based on the following expression (3) using a standard deviation (μm) in the volume particle size distribution. A smaller coefficient of variation means a narrower particle size distribution.

$$\text{CV value}(\%)=\{\text{Standard deviation}(\mu m)\text{in volume particle size distribution}/\text{Volume average particle size}(\mu m)\}\times 100 \quad (3)$$

[Amount of Release Agent in Toner Particle Surface]

One gram of a toner was dispersed in 20 ml of hexane and in dispersion thus formed, a stirrer was put to agitate the dispersion for 10 minutes so as to elute the release agent in the toner particle surface. After that, the dispersion was filtered and then dried overnight in a drier set at 40° C. For both of the toner treated by hexane elution and the toner not treated by hexane elution, heat capacity of the toners was measured in the above measurement conditions by using a differential scanning calorimeter: DSC220 (trade name) manufactured by Seiko Electronics Inc. And a difference between the heat capacity of the toners was used to estimate the amount of the release agent in the toner particle surface.

[Average Degree of Circularity]

Dispersion was prepared by dispersing 5 mg of a toner in 10 ml of water having about 0.1 g of surfactant dissolved therein. The dispersion was irradiated, for five minutes with ultrasonic wave which was 20 kHz in frequency and 50 W in outputs, to thereby adjust concentration of toner particles in the dispersion to 5,000 pieces/μL to 20,000 pieces/μL. The above-mentioned flow particle image analyzer: FPIA-3000 manufactured by Sysmex Corporation was then used to measure the degrees of circularity (ai) based on the above expression (1). After that, an average degree of circularity (a) was calculated from the measurement result of the degrees of circularity by a simple calculation method.

[Melting Temperature]

Using the differential scanning calorimeter: DSC220 (trade name) manufactured by Seiko Electronics Inc., 1 g of a sample was heated from 20° C. up to 200° C. at a temperature of which increase rate was 10° C./min, and then an operation of rapidly cooling down the sample from 200° C. to 20° C. was repeated twice, thus obtaining a DSC curve. A temperature obtained at a top of an endothermic peak which corresponds to the melting shown on the DSC curve obtained at the second operation, was determined as the melting temperature.

Example 1

Toner raw materials were mixed for 10 minutes by a Henschel mixer. The toner row materials contained 81.8 parts by weight of polyester which serves as a binder resin: FC1494 (trade name) manufactured by Mitsubishi Rayon Co., Ltd., having a glass transition temperature (Tg) of 62° C. and a softening temperature (Tm) of 127° C.; 12 parts by weight of master batch containing 40% by weight of C.I. pigment red 57:1; 4.8 parts by weight of paraffin wax which serves as a release agent: HNP10 (trade name) manufactured by Nippon Seiro Co., Ltd., having a melting temperature of 75° C.; and 1.5 parts by weight of alkyl salicylate metal salt which serves as a charge control agent: BONTRON E-84 (trade name) manufactured by Orient Chemical Industries, Ltd. And an admixture thus obtained, was melt-kneaded by a twin screw extruder: PCM65 (trade name) manufactured by Ikegai Co. A melt-kneaded product was thus prepared.

The melt-kneaded product was coarsely pulverized by means of a cutting mill: VM-16 (trade name) manufactured by Ryoko Industry Ltd., thereafter being finely pulverized by a counter jet mill. After that, an impact-type spheronizing device: FACULTY F-600 (trade name) manufactured by Hosokawa Micron Corporation was used to conduct the spheronization process, and excessively pulverized toner particles were classified and thus removed by a rotary classifier.

After that, 3.8 parts by weight in total of the external additives were mixed by the Henschel mixer: FMMIXER (trade name) manufactured by Mitsui Mining Co., Ltd. The external additives consisted of 2.2 parts by weight of hydrophobic silica: R-974 (trade name) manufactured by Nippon Aerosil Co., Ltd. and 1.6 parts by weight of hydrophobic titanium: T-805 (trade name) manufactured by Nippon Aerosil Co., Ltd. Toner particles of Example 1 were thus prepared. A volume average particle size of the toner particles was 5.5 μm, and in the toner particles, a content of 5.0 μm or smaller particles was 45% by number while a content of 8.0 μm or larger particles was 1.5% by volume, an average degree of circularity of the toner particles was 0.958, and an amount of the release agent in the toner particle surface was 1.6% by weight.

Further, a ferrite core carrier having a volume average particle size of 45 μm was used as a carrier. The carrier was mixed with the toner for 20 minutes by means of a V-type mixer: V-5 (trade name) manufactured by Tokuju Corporation so as to be 60% in coverage of the toner over the carrier. A two-component developer of Example 1 was thus prepared.

Example 2

A toner and a two-component developer of Example 2 were manufactured in the same manner as in Example 1, except that the amount of the release agent in the preliminarily mixing step was changed to 4.2 parts by weight. The amount of the release agent in the toner particle surface was 1.2% by weight.

Example 3

A toner and a two-component developer of Example 3 were manufactured in the same manner as in Example 1, except that the amount of the release agent in the preliminarily mixing step was changed to 3.0 parts by weight. The amount of the release agent in the toner particle surface was 1.0% by weight.

Example 4

A toner and a two-component developer of Example 4 were manufactured in the same manner as in Example 1, except that the amount of the release agent in the preliminarily mixing step was changed to 2.5 parts by weight. The amount of the release agent in the toner particle surface was 0.7% by weight.

Example 5

A toner and a two-component developer of Example 5 were manufactured in the same manner as in Example 1, except that the average degree of circularity of the toner particles was adjusted to 0.952 by changing the operating conditions in the spheronizing step. A volume average particle size of the toner particles was 5.9 μm, and in the toner particles, a content of 5.0 μm or smaller particles was 45% by number while a content of 8.0 μm or larger particles was 1.5% by volume.

Example 6

A toner and a two-component developer of Example 6 were manufactured in the same manner as in Example 1, except that the average degree of circularity of the toner particles was adjusted to 0.960 by changing the operating conditions in the spheronizing step. A volume average particle size of the toner particles was 5.2 μm, and in the toner particles, a content of 5.0 μm or smaller particles was 51% by number while a content of 8.0 μm or larger particles was 1.1% by volume.

Example 7

A toner and a two-component developer of Examples 7 were manufactured in the same manner as in Example 1, except that the average degree of circularity of the toner particles was adjusted to 0.962 by changing the operating conditions in the spheronizing step. A volume average particle size of the toner particles was 5.1 μm, and in the toner particles, a content of 5.0 μm or smaller particles was 54% by number while a content of 8.0 μm or larger particles was 0.8% by volume.

Example 8

A toner and a two-component developer of Example 8 were manufactured in the same manner as in Example 1, except that the average degree of circularity of the toner particles was set to be 0.948 by not providing the spheronizing step. A volume average particle size of the toner particles was 5.8 μm, and in the toner particles, a content of 5.0 μm or smaller particles was 42% by number while a content of 8.0 μm or larger particles was 1.6% by volume.

Example 9

A toner and a two-component developer of Example 9 were manufactured in the same manner as in Example 1, except that the amount of the external additive was changed to 2.2 parts by weight.

Example 10

A toner and a two-component developer of Example 10 were manufactured in the same manner as in Example 1, except that the release agent was changed to carnauba wax: REFINED CARNAUBA WAX (trade name) manufactured by S.KATO & CO., having a melting temperature of 83° C. and that one amount of the release agent in the preliminarily mixing step was changed to 5.8 parts by weight. The amount of the release agent in the toner particle surface was 1.8% by weight.

Example 11

A toner and a two-component developer of Example 11 were manufactured in the same manner as in Example 1, except that the release agent was changed to paraffin wax: HNP11 (trade name) manufactured by Nippon Seiro Co., Ltd., having a melting temperature of 68° C.

Example 12

A toner and a two-component developer of Example 12 were manufactured in the same manner as in Example 1, except that the release agent was changed to microcryst al line wax: HI-MIC-2045 (trade name) manufactured by Nippon Seiro Co., Ltd., having a melting temperature of 67° C.

Example 13

A toner and a two-component developer of Example 13 were manufactured in the same manner as in Example 1, except that the amount of the external additive was changed to 4.2 parts by weight.

Example 14

A toner and a two-component developer of Example 14 were manufactured in the same manner as in Example 1, except that the amount of the external additive was changed to 1.8 parts by weight.

Example 15

A toner and a two-component developer of Example 15 were manufactured in the same manner as in Example 1, except that the volume average particle size of the carrier was changed to 55 μm.

Comparative Example 1

A toner and a two-component developer of Comparative example 1 were manufactured in the same manner as in Example 1, except that the amount of the release agent in the preliminarily mixing step was changed to 6.1 parts by weight.

The amount of the release agent in the toner particle surface was 2.0% by weight which exceeded the predetermined range.

Comparative Example 2

A toner and a two-component developer of Comparative example 2 were manufactured in the same manner as in Example 1, except that the amount of the release agent in the preliminarily mixing step was changed to 2.3 parts by weight. The amount of the release agent in the toner particle surface was 0.6% by weight which was smaller than the predetermined range.

Comparative Example 3

A toner and a two-component developer of Comparative example 3 were manufactured in the same manner as in Example 1, except that the volume average particle size of the toner particles was set to be 2.8 μm by changing the pulverization condition and the classification condition. In the toner particles, a content of 5.0 μm or smaller particles was 65% by number while a content of 8.0 μm or larger particles was 0.2% by volume.

Comparative Example 4

A toner and a two-component developer of Comparative example 4 were manufactured in the same manner as in Example 1, except that the volume average particle size of the toner particles was set to be 6.2 μm which exceeded the predetermined range of particle size by changing the pulverization condition and the classification condition. In the toner particles, a content of 5.0 μm or smaller particles was 42% by number while a content of 8.0 μm or larger particles was 1.9% by volume.

Comparative Example 5

A toner and a two-component developer of Comparative example 5 were manufactured in the same manner as in Example 1, except that the content of 5.0 μm or smaller toner particles was set to be 38% by number by changing the classification condition. The volume average particle size of the toner particles was 5.9 μm, and the content of 8.0 μm or larger toner particles was 1.5% by volume.

Comparative Example 6

A toner and a two-component developer of Comparative example 6 were manufactured in the same manner as in Example 1, except that the content of 5.0 μm or smaller toner particles was set to be 56% by number which exceeded the predetermined range of particle size distribution, by changing the classification condition. The volume average particle size of the toner particles was 4.6 μm, and the content of 8.0 μm or larger toner particles was 0.5% by volume.

Comparative Example 7

A toner and a two-component developer of Comparative example 7 were manufactured in the same manner as in Example 1, except that the content of 8.0 μm or larger toner particles was set to be 3.0% by volume which exceeded the predetermined range of particle size distribution, by changing the classification condition. The volume average particle size of the toner particles was 5.8 μm, and the content of 5.0 μm or smaller toner particles was 40% by number.

Table 1 collectively shows properties of the toners and two-component developers obtained in Examples 1 to 15 and Comparative examples 1 to 7.

TABLE 1

| | Amount of surface release agent [wt %] | Amount of added release agent [wt %] | Kind of release agent | Melting temperature of release agent [° C.] | Amount of external additive [part by weight] | Volume average particle size of toner particles [μm] | 5.0 μm or smaller particles [% by number] | 8.0 μm or larger particles [% by volume] | Average degree of circularity | Volume average particle size of carrier [μm] |
|---|---|---|---|---|---|---|---|---|---|---|
| Example 1 | 1.6 | 4.8 | Paraffin | 75 | 3.8 | 5.5 | 45 | 1.5 | 0.958 | 45 |
| Example 2 | 1.2 | 4.2 | Paraffin | 75 | 3.8 | 5.7 | 42 | 1.5 | 0.959 | 45 |
| Example 3 | 1.0 | 3.0 | Paraffin | 75 | 3.8 | 5.0 | 47 | 1.8 | 0.957 | 45 |
| Example 4 | 0.7 | 2.5 | Paraffin | 75 | 3.8 | 3.2 | 53 | 0.5 | 0.955 | 45 |
| Example 5 | 1.6 | 4.8 | Paraffin | 75 | 3.8 | 5.9 | 45 | 1.5 | 0.952 | 45 |
| Example 6 | 1.6 | 4.8 | Paraffin | 75 | 3.8 | 5.2 | 51 | 1.1 | 0.960 | 45 |
| Example 7 | 1.6 | 4.8 | Paraffin | 75 | 3.8 | 5.1 | 54 | 0.8 | 0.962 | 45 |
| Example 8 | 1.6 | 4.8 | Paraffin | 75 | 3.8 | 5.8 | 42 | 1.6 | 0.948 | 45 |
| Example 9 | 1.6 | 4.8 | Paraffin | 75 | 2.2 | 5.5 | 45 | 1.5 | 0.958 | 45 |
| Example 10 | 1.8 | 5.8 | Carnauba | 83 | 3.8 | 5.0 | 49 | 1.8 | 0.955 | 45 |
| Example 11 | 1.6 | 4.8 | Paraffin | 68 | 3.8 | 5.2 | 43 | 1.0 | 0.955 | 45 |
| Example 12 | 1.5 | 4.8 | Microcrystalline | 67 | 3.8 | 5.7 | 50 | 1.7 | 0.956 | 45 |
| Example 13 | 1.6 | 4.8 | Paraffin | 75 | 4.2 | 5.5 | 45 | 1.5 | 0.958 | 45 |
| Example 14 | 1.6 | 4.8 | Paraffin | 75 | 1.8 | 5.5 | 45 | 1.5 | 0.958 | 45 |
| Example 15 | 1.6 | 4.8 | Paraffin | 75 | 3.8 | 5.5 | 45 | 1.5 | 0.958 | 55 |
| Comparative example 1 | 2.0 | 6.1 | Paraffin | 75 | 3.8 | 5.4 | 42 | 1.5 | 0.958 | 45 |
| Comparative example 2 | 0.6 | 2.3 | Paraffin | 75 | 3.8 | 5.8 | 47 | 1.4 | 0.955 | 45 |
| Comparative example 3 | 1.4 | 4.1 | Paraffin | 75 | 3.8 | 2.8 | 65 | 0.2 | 0.960 | 45 |
| Comparative example 4 | 1.1 | 4.8 | Paraffin | 75 | 3.8 | 6.2 | 42 | 1.9 | 0.951 | 45 |
| Comparative example 5 | 1.4 | 4.8 | Paraffin | 75 | 3.8 | 5.9 | 38 | 1.5 | 0.958 | 45 |
| Comparative example 6 | 1.4 | 4.8 | Paraffin | 75 | 3.8 | 4.6 | 56 | 0.5 | 0.956 | 45 |

TABLE 1-continued

| | Amount of surface release agent [wt %] | Amount of added release agent [wt %] | Kind of release agent | Melting temperature of release agent [° C.] | Amount of external additive [part by weight] | Volume average particle size of toner particles [μm] | 5.0 μm or smaller particles [% by number] | 8.0 μm or larger particles [% by volume] | Average degree of circularity | Volume average particle size of carrier [μm] |
|---|---|---|---|---|---|---|---|---|---|---|
| Comparative example 7 | 1.4 | 4.8 | Paraffin | 75 | 3.8 | 5.8 | 40 | 3.0 | 0.955 | 45 |

Using the two-component developers obtained in Examples and Comparative examples, the fog on the non-image part, the fixing property, the cleaning property, and the preservation stability were evaluated respectively in the following manners.

[Fog on Non-image Parts]

A commercially-available copier: MX-4500 (trade name) manufactured by Sharp Corporation was filled with the two-component developer, and a printing operation was executed in the condition that an amount of the toner to be attached onto a photoreceptor is adjusted to 0.4 mg/cm$^2$. The toner attached onto the non-image part in this state was collected by an adhesive tape, and image density (ID) of the toner was measured by a colorimeter: X-Rite 938 (trade name) manufactured by X-Rite Inc. Evaluations were conducted according to the following criteria.

Excellent: Very favorable. ID was less than 0.05.

Good: Favorable. ID was 0.05 or more and less than 0.1.

Available: No problem for practical use. ID was 0.1 or more and less than 0.2.

Poor: Defective. ID was 0.2 or more.

[Image Reproducibility]

A document having an original image drawn in exact-100 μm-wide thin lines was copied by the color copier: MX-4500 (trade name) manufactured by Sharp Corporation, under a condition that an image having image density of 0.3 or more and 0.5 or less can be formed from a 5 mm-diameter halftone image having image density of 0.3. A copy image thus obtained was used as a measurement sample. A width of thin line formed in the measurement sample was determined by an indicator on the basis of a monitor image which was obtained by enlarging the measurement sample at 100-fold magnification using a particle analyzer: LUZEX450 (trade name) manufactured by Nireco Corporation). The thin line had irregularities and therefore was different in width from one measurement position to another. The line width was thus measured at plural measurement positions, and their average was taken and determined as a line width of the measurement sample. The line width of the measurement, sample was divided by 100 μm which was a line width of the original image, and a resultant value was multiplied by 100. A value thus obtained was determined as a value of thin line reproducibility. As this value of thin line reproducibility is closer to 100, it indicates better reproducibility of thin lines, more excellent image reproducibility, and higher resolution. The criteria for evaluation were as follows. Note that the image density refers to optical reflection density measured by a reflection densitometer: RD-918 (trade name) manufactured by Macbeth Corporation.

Excellent: The value of the thin line reproducibility was 100 or more and less than 105.

Good: The value of the thin line reproducibility was 105 or more and less than 115.

Available: The value of the thin line reproducibility was 115 or more and less than 125.

Poor: The value of the thin line reproducibility was 125 or more.

[Fixing Property]

Using a remodeled machine of the multifunctional color printer: MX-4500 (trade name) manufactured by Sharp Corporation, an unfixed image was formed on a recording medium, i.e., a recording sheet that was specifically a PPC sheet: SF-4AM3 (trade name) manufactured by Sharp Corporation, from a sample image containing a rectangular solid image part of 20 mm in height by 50 mm in width so that an amount of unfixed toner in the solid image part to be attached to the recording sheet was adjusted to be 0.5 mg/cm$^2$. The unfixed image was then formed into a fixed image by use of an external fixing device created from a fixing section of the multifunctional color printer. A processing speed for fixing was set at 124 mm/sec, and a temperature of a fixing roller was increased from 130° C. by 5° C. at a time. A temperature range causing neither low-temperature offset nor high-temperature offset was determined as a fixing non-offset range.

The high-temperature offset and the low-temperature offset were defined as follows. As some toner is unfixed to the recording sheet during the fixing operation and remains on a fixing roller, the toner may be attached to the recording sheet after the fixing roller goes into a 360-degree roll with the toner. This situation was referred to as occurrence of offset.

Excellent: The fixing non-offset range covered temperatures of 60° C. and higher.

Good: The fixing non-offset range covered temperatures of 45° C. or higher and lower than 60° C.

Available: The fixing non-offset range covered temperatures of 35° C. or higher and lower than 45° C.

Poor: The fixing non-offset range covered temperatures lower than 35° C.

[Cleaning Property]

A pressure of a cleaning blade was adjusted so that an initial linear pressure attained to 25 gf/cm ($2.45\times10^{-1}$ N/cm), wherein the pressure of the cleaning blade refers to a pressure occurring when the cleaning blade of a cleaning unit disposed in the commercially-available copier: MX-4500 (trade name) manufactured by Sharp Corporation makes contact with the photoreceptor drum. This copier was filled with the two-component developers respectively containing the toners of Examples 1-15 and Comparative examples 1-7. By using such a copier as just described, 100,000 copies of a character test chart created by Sharp Corporation were made in an environment having ordinary temperature and humidity, that is, 25° C. in temperature and 50% in relative humidity. The cleaning property was thus determined.

As for the cleaning property, by checking a formed image with eyes in three stages: before the image was formed (an initial stage); after 5,000 (5K) copies were made; and after 10,000 (10K) copies were made, a test was conducted on definition of a boundary located between an image part and a non-image part, as well as on existence or nonexistence of a black streak formed of a toner leaking in a rotation direction of the photoreceptor drum. Further, an amount of fog Wk of the formed image was determined by a later-described measuring device and the cleaning property was evaluated.

By using a color measuring system Z-Σ90 manufactured by Nippon Denshoku Industries Co., Ltd., reflection density was measured, and the amount of fog Wk of the formed image was determined as follows. First of all, reflection average density Wr of a recording sheet was measured prior to image formation. Next, an image was formed on the recording sheet and after the image formation, the reflection density was then measured at different white parts of the recording sheet. A value obtained according to the following expression (4) was defined as the amount of fog Wk (%), wherein Ws represents reflection density of a part having the largest fog amount, namely a white part highest in density, and Wr represents the reflection average density described above. Evaluation criteria are as follows.

$$Wk(\%)=100\times((Ws-Wr)/Wr) \quad (4)$$

Excellent: Very favorable. The definition was good and no black streak appeared. And the amount of fog Wk was less than 3%.

Good: Favorable. The definition was good and no black streak appeared. And the amount of fog Wk was 3% or more and less than 5%.

Available: No problem in practical use. The definition basically did not induce a problem in practical use and the break streaks were 2.0 mm or less in length and 5 pieces or less in number. And the amount of fog Wk was 5% or more and less than 10%.

Poor: Unusable in practice. There existed a problem in definition in practical use. The black streaks were at least either greater than 2.0 mm in length or 6 pieces or more in number. And the amount of fog Wk was 10% or more.

[Preservation Stability]

In each of three 50 ml-polyethylene bottles, 28 g to 30 g of a toner was put. The polyethylene bottles with their lids closed were put in a thermo-hygrostat maintaining 50° C. and 10% RH. The polyethylene bottles were taken out one by one for every 24 hours, and using a bulk specific gravity tester manufactured by Tsutsui science instrument Co., Ltd., bulk density of each toner was measured in accordance with JIS K-5101-12-1. The bulk density measured in the initial stage and the bulk density measured after a lapse of 72 hours were compared with each other. A toner less fluctuating was determined as having better preservation stability. The criteria for evaluation were as follows.

To be specific, the coefficient of fluctuation was calculated by the following expression (5).

$$\text{(Coefficient of fluctuation)}=\text{(Bulk density after 72 hours)}/\text{(Initial bulk density)}\times 100 \quad (5)$$

Excellent: The coefficient of fluctuation was 90% or more.

Good: The coefficient of fluctuation was 80% or more and less than 90%.

Poor: The coefficient of fluctuation was less than 80%.

[Comprehensive Evaluation]

The criteria for comprehensive evaluation were as follows.

Excellent: Very favorable. All items were given "Excellent".

Good: Favorable. The evaluation result contained no "Available" and "Poor".

Available: No problem in practical use. No "Poor" was given and one or two "Available" were given in the evaluation result.

Poor: Defective. At least one "Poor" was given and three or more "Available" were given in the evaluation result.

Table 2 shows the evaluation results and comprehensive evaluation results of the toners and two-component developers obtained in Examples 1 to 15 and Comparative examples 1 to 7.

TABLE 2

| | Fog on non-image part | Thin line reproducibility | Fixing non-offset range [° C.] | Cleaning property | Preservation stability | Comprehensive evaluation |
|---|---|---|---|---|---|---|
| Example 1 | Excellent | Excellent | 60(140-200) [Excellent] | Excellent | Excellent | Excellent |
| Example 2 | Excellent | Excellent | 60(140-200) [Excellent] | Excellent | Excellent | Excellent |
| Example 3 | Excellent | Excellent | 60(140-200) [Excellent] | Excellent | Excellent | Excellent |
| Example 4 | Excellent | Excellent | 45(140-185) [Good] | Excellent | Excellent | Good |
| Example 5 | Excellent | Excellent | 60(140-200) [Excellent] | Excellent | Excellent | Excellent |
| Example 6 | Excellent | Excellent | 60(140-200) [Excellent] | Excellent | Excellent | Excellent |
| Example 7 | Excellent | Excellent | 60(140-200) [Excellent] | Good | Excellent | Good |
| Example 8 | Good | Excellent | 60(140-200) [Excellent] | Excellent | Excellent | Good |
| Example 9 | Excellent | Excellent | 60(140-200) [Excellent] | Excellent | Excellent | Excellent |
| Example 10 | Excellent | Excellent | 55(145-200) [Good] | Excellent | Excellent | Good |
| Example 11 | Excellent | Excellent | 60(140-200) [Excellent] | Excellent | Good | Good |
| Example 12 | Excellent | Excellent | 55(145-200) [Good] | Excellent | Excellent | Good |
| Example 13 | Good | Excellent | 55(145-200) [Good] | Excellent | Excellent | Good |
| Example 14 | Good | Excellent | 60(140-200) [Excellent] | Excellent | Excellent | Good |
| Example 15 | Good | Excellent | 60(140-200) [Excellent] | Excellent | Excellent | Good |
| Comparative example 1 | Available | Excellent | 60(140-200) [Excellent] | Excellent | Good | Available |

TABLE 2-continued

| | Fog on non-image part | Thin line reproducibility | Fixing non-offset range [° C.] | Cleaning property | Preservation stability | Comprehensive evaluation |
|---|---|---|---|---|---|---|
| Comparative example 2 | Excellent | Excellent | 30(145-175) [Poor] | Excellent | Excellent | Poor |
| Comparative example 3 | Poor | Excellent | 60(140-200) [Excellent] | Poor | Excellent | Poor |
| Comparative example 4 | Excellent | Available | 60(140-200) [Excellent] | Excellent | Excellent | Available |
| Comparative example 5 | Excellent | Available | 60(140-200) [Excellent] | Excellent | Excellent | Available |
| Comparative example 6 | Poor | Excellent | 60(140-200) [Excellent] | Available | Excellent | Poor |
| Comparative example 7 | Excellent | Available | 60(140-200) [Excellent] | Excellent | Excellent | Available |

The above results revealed that in each Example, the fluidity was favorable and the charge on each of the toner having small particles was able to be controlled properly, therefore leading to no decrease in the fixing property and thus allowing for formation of a high-quality image not suffering from the fog on the non-image part, which fog is a problem imposed by the decrease in size of toner particles.

In present Examples, a magenta toner was used as a toner. This is because C.I. pigment red 57:1 adapted for magenta was contained as colorant. Note that the colorant may be replaced by any one of the variety of colorants listed above.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner comprising toner particles containing at least a binder resin, colorant, and a release agent, the toner particles having a volume average particle size of 3.0 μm to 6.0 μm of which 5.0 μm or smaller particles make up 40% by number or more and 8.0 μm or larger particles make up less than 2% by volume, and the release agent being a petroleum-based release agent and present in a toner particle surface in amount of 0.7% by weight or more and 1.8% by weight or less.

2. The toner of claim 1, wherein the release agent present in the toner particle surface is 1.0% by weight or more and 1.8% by weight or less.

3. The toner of claim 1, wherein the toner particles have an average degree of circularity of 0.950 or more and 0.960 or less.

4. The toner of claim 1, wherein the release agent has a melting temperature of 70° C. or more.

5. The toner of claim 1, wherein the petroleum-based release agent is a paraffin-based release agent.

6. The toner of claim 1, wherein an external additive is contained in an amount of 2.0 parts by weight or more and less than 4.0 parts by weight based on 100 parts by weight of the toner particles.

7. A two-component developer containing the toner of claim 1 and a carrier.

8. The two-component developer of claim 7, wherein the carrier has a volume average particle size of 50 μm or less.

9. A developing device performing development by use of the two-component developer of claim 7.

10. An image forming apparatus having the developing device of claim 9.

* * * * *